US006267465B1

(12) United States Patent
Sawicki

(10) Patent No.: US 6,267,465 B1
(45) Date of Patent: Jul. 31, 2001

(54) WASTE INK PAD SYSTEM AND METHOD OF MANUFACTURING AN IMPROVED WASTE PAD

(75) Inventor: Paul F. Sawicki, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/594,690

(22) Filed: Jun. 16, 2000

(51) Int. Cl.[7] ..... B41J 2/165
(52) U.S. Cl. ..... 347/36
(58) Field of Search ..... 347/36, 31, 22, 347/29, 30, 35

(56) References Cited

U.S. PATENT DOCUMENTS 4,701,771 * 10/1987 Ikeda ..... 347/36
4,746,938 5/1988 Yamamori et al. .
4,853,717 8/1989 Harmon et al. .
4,855,764 8/1989 Humbs et al. .
5,151,715 9/1992 Ward et al. .
5,250,962 10/1993 Fisher et al. .
5,339,102 8/1994 Carlotta .
5,500,659 3/1996 Curran, Jr. et al. .
5,548,310 8/1996 Binnert et al. .
5,659,341 8/1997 Kinas .
5,943,071 8/1999 Premnath .

FOREIGN PATENT DOCUMENTS 8-238782 * 9/1996 (JP) ..... B41J/2/175
11-085780 * 3/1999 (JP) ..... B41J/2/175

* cited by examiner

*Primary Examiner*—David F. Yockey
(74) *Attorney, Agent, or Firm*—Oliff & Berridge, PLC

(57) ABSTRACT

A waste ink pad system includes a separate first and second pad of absorbent material, each pad having a hole which is blocked by the opposing pad. The rate of evaporation of volatile components from waste ink is reduced by introducing the waste ink into the waste ink pad system at an interface between the first and second pads through a sleeve inserted into one of the blocked holes.

22 Claims, 3 Drawing Sheets

WASTE INK PAD SYSTEM AND METHOD OF MANUFACTURING AN IMPROVED WASTE PAD

BACKGROUND OF THE INVENTION

1. Field of Invention

This invention relates to maintenance stations for ink jet printing apparatus.

2. Description of Related Art

Ink jet printers have at least one printhead that directs droplets of ink towards a recording medium. Within the printhead, the ink may be contained in a plurality of channels. Energy pulses are used to expel the droplets of ink, as required, from orifices at the ends of the channels.

In a thermal ink jet printer, the energy pulses are usually produced by resistors. Each resistor is located in a respective one of the channels, and is individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink to form a droplet moving in a direction away from the channel and towards the recording medium. The channel is then re-filled by capillary action, which in turn draws ink from a supply container. Operation of a thermal ink jet printer is described in, for example, U.S. Pat. No. 4,849,774.

A carriage-type thermal ink jet printer is described in U.S. Pat. No. 4,638,337. That printer has a plurality of printheads, each with its own ink tank cartridge, mounted on a reciprocating carriage. The channel orifices in each printhead are aligned perpendicular to the line of movement of the carriage. A swath of information is printed on the stationary recording medium as the carriage is moved in one direction. The recording medium is then stepped, perpendicular to the line of carriage movement, by a distance equal to the width of the printed swath. The carriage is then moved in the reverse direction to print another swath of information.

The ink ejecting orifices of an ink jet printer need to be maintained, for example, by periodically cleaning the orifices when the printer is in use, and/or by capping the printhead when the printer is out of use or is idle for extended periods. Capping the printhead is intended to prevent the ink in the printhead from drying out. The cap provides a controlled environment to prevent ink exposed in the nozzles from drying out.

A printhead may also need to be primed before initial use, to ensure that the printhead channels are completely filled with the ink and contain no contaminants or air bubbles. After much printing, and at the discretion of the user, an additional but reduced volume prime may be needed to clear particles or air bubbles which cause visual print defects. Maintenance and/or priming stations for the printheads of various types of ink jet printers are described in, for example, U.S. Pat. No. 4,364,065; 4,855,764; 4,853,717 and 4,746,938, while the removal of gas from the ink reservoir of a printhead during printing is described in U.S. Pat. No. 4,679,059.

The priming operation, which usually involves either forcing or drawing ink through the printhead, can leave drops of ink on the face of the printhead. As a result, ink residue builds up on the printhead face. This ink residue can have a deleterious effect on the print quality. Paper fibers and other foreign material can also collect on the printhead face while printing is in progress. Like the ink residue, this foreign material can also have deleterious effects on print quality. The 717 patent discloses moving a printhead across a wiper blade at the end of a printing operation so that dust and other contaminants are scraped off the orifice before the printhead is capped, and capping the printhead nozzle by moving the printer carriage acting on a sled carrying the printhead cap. This eliminates the need for a separate actuating device for the cap. The 938 patent also discloses providing an ink jet printer with a washing unit which, at the end of the printing operation, directs water at the face of the printhead to clean the printhead before it is capped.

SUMMARY OF THE INVENTION

This invention provides a waste pad system and method of manufacturing a waste pad, usable with a maintenance station.

The printer has one or more printheads that are primed by negative pressure created by a vacuum pump. Ink is primed for one or more printheads into one or more printhead caps of the maintenance station. In various exemplary embodiments, the one or more printheads eject both pigment-based inks and dye-based inks. The pigment-based and dye-based inks are drawn through one or more maintenance caps, connecting tubing, ink manifold and finally deposited in a waste pad system. As the inks are deposited in the waste pad assembly, the fluid inks are absorbed and migrate through the waste pads before the waste ink dries.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail with reference to the following figures, wherein like numerals represent like elements, and wherein.

DETAILED DESCRIPTION OF EXEMPLARY EMBODIMENTS

Figure 1:
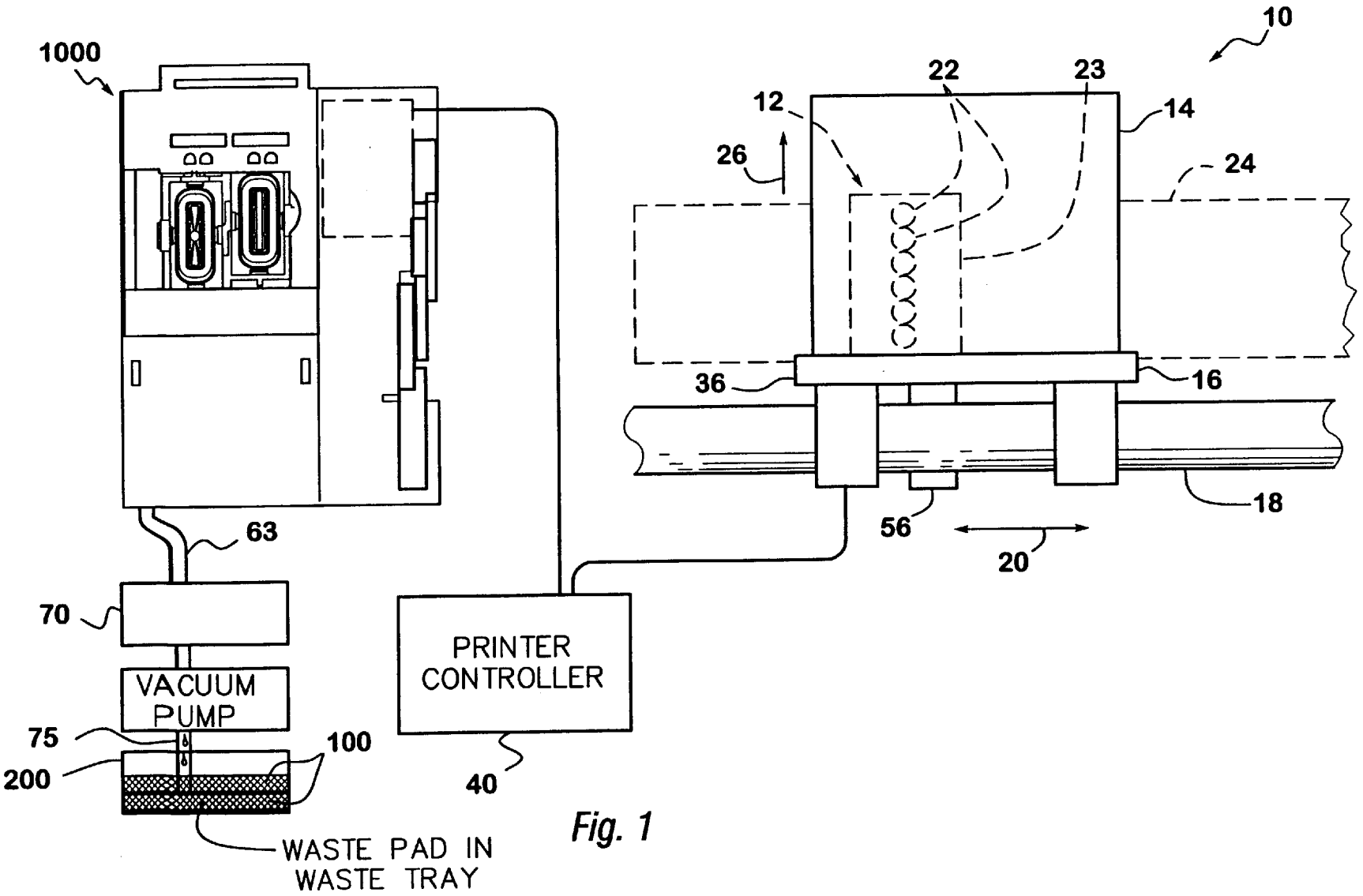
FIG. 1 is a schematic front elevation view of an ink jet printer and a maintenance station according to this invention.

FIG. 1 shows a printer 10, including one or more printheads 12, shown in dashed line, fixed to an ink supply cartridge 14. The ink supply cartridge 14 is removably mounted on a carriage 16. The carriage 16 is translatable back and forth on one or more guide rails 18 as indicated by arrow 20, so that the one or more printheads 12 and the ink supply cartridge 14 move concurrently with the carriage 16. Each of the one or more printheads 12 contains a plurality of ink channels which terminate in nozzles 22 in a nozzle face 23 (both shown in dashed line). The ink channels carry ink from the ink supply cartridge 14 to the printhead nozzles 22.

When the printer 10 is in a printing mode, the carriage 16 translates or reciprocates back and forth across and parallel to a printing zone 24 (shown in dashed line). Ink droplets are selectively ejected on demand from the printhead nozzles 22 onto a recording medium, such as paper, positioned in the printing zone, to print information on the recording medium one swath or portion at a time. During each pass or translation in one direction of the carriage 16, the recording medium is stationary. At the end of each pass, the recording medium is stepped in the direction of arrow 26 for the distance or the height of one printed swath. U.S. Pat. No. 4,571,599 and U.S. Pat. No. Re. 32,572, each incorporated herein by reference in its entirety, provide a more detailed explanation of the printhead and the printing operation.

When the printer 10 is no longer in a printing mode, the carriage 16 travels to a maintenance station 1000 spaced from the printing zone 24. With the one or more printheads 12 positioned at the maintenance station 1000, various maintenance functions can be performed on the one or more printheads 12.

As shown in FIG. 1, the maintenance station 1000 includes a one or more printhead caps that are engagable with the one or more printheads 12 to withdraw ink, debris and the like from the nozzles 22 of the one or more printheads 12. The waste ink withdrawn from the ink jet printheads 12 by the printhead caps are expelled or withdrawn from the maintenance station 1000 through one or more tubes into a waste ink manifold 70 by a vacuum pump.

In various exemplary embodiments, the one or more printheads 12 eject both pigment-based inks and dye-based inks. One exemplary embodiment of a pigment-based ink is carbon-black based black ink. One exemplary embodiment of dye-based inks are the cyan, magenta and yellow colored inks commonly used in ink jet printers. However, it should be appreciated that the pigment-based and dye-based inks are not limited to these exemplary embodiments. It should also be appreciated that the printer can use a single printhead that ejects both pigment-based and dye-based inks, one or more printheads that eject only pigment-based inks with one or more printheads that eject only dye-based inks, or a one or more printheads, where each such printhead has a vast array of nozzles that eject only pigment-based inks, and another, spaced-apart array of nozzles that ejects only dye-based inks, or any combination of these or other types of printheads.

The waste ink is then drawn from the waste ink manifold, by the vacuum pump, into a waste ink pad system 200 according to this invention. As shown in FIGS. 2–5, in various exemplary embodiments, the waste ink pad system 200 includes a tray 210 into which are placed one or more ink pads 100.

Figure 2:
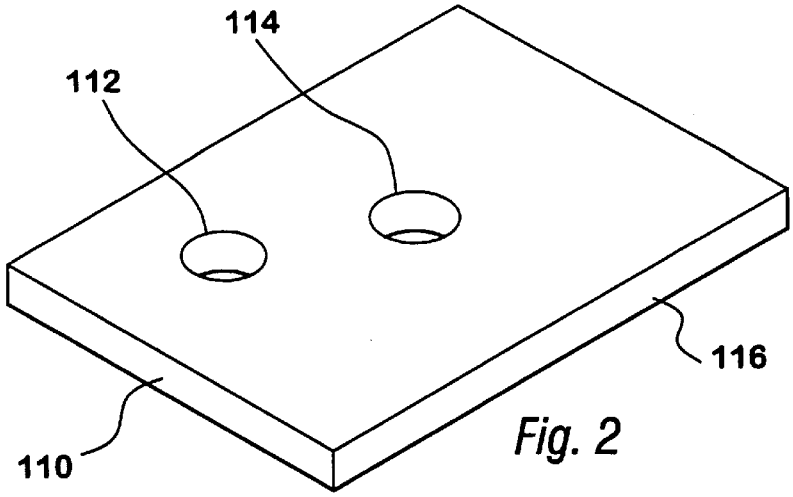
FIG. 2 is a perspective view of a top waste pad of one exemplary embodiment, of the improved waste pad system of FIG. 4.
Figure 3:
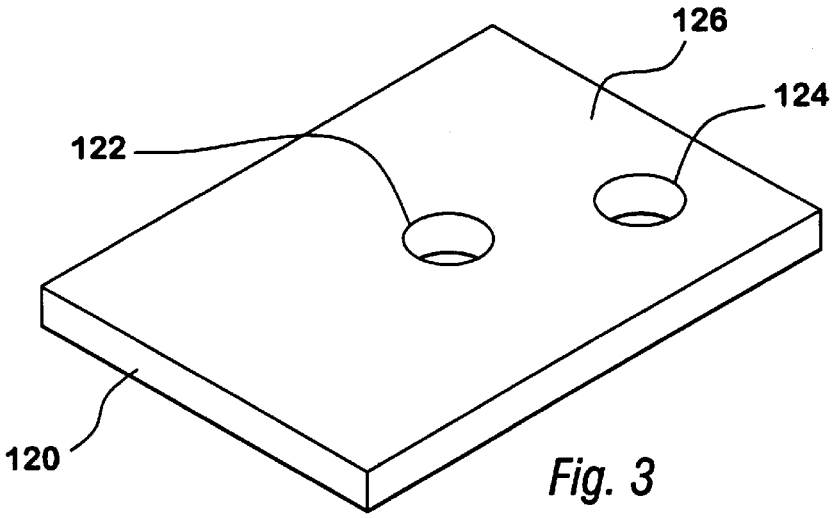
FIG. 3 is a perspective view of a lower waste pad of one exemplary embodiment, of the improved waste pad system of FIG. 4.
Figure 4:
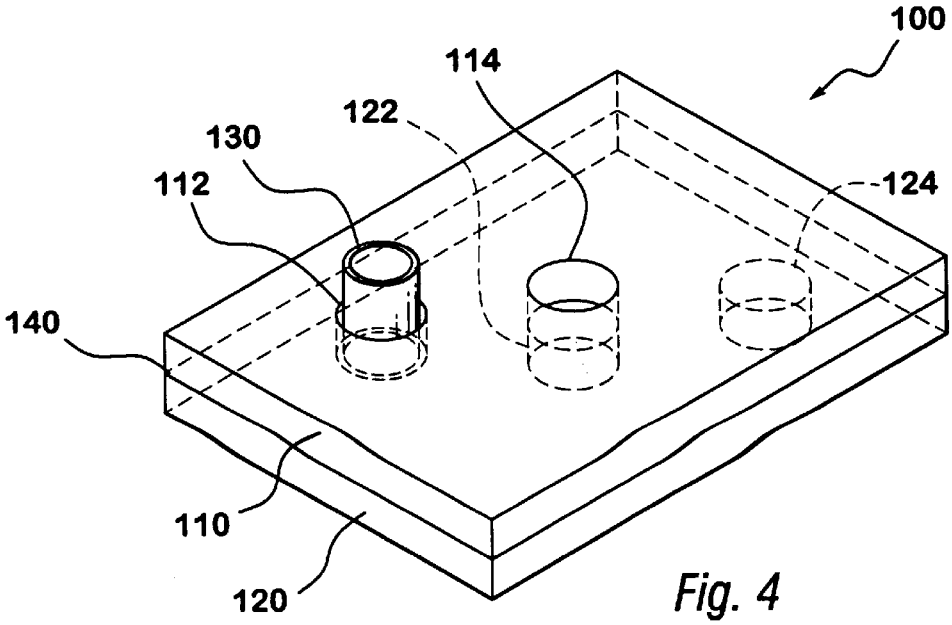
FIG. 4 is a perspective view of a waste pad formed by combining the waste pads of FIGS. 2 and 3.

FIGS. 2 and 3 illustrate one exemplary embodiment of a waste ink pad 100 useable with the waste ink pad system 200 according to this invention. In particular, FIGS. 2–4 show a single waste ink pad 100 that is created using a first waste ink pad 110 and a second waste ink pad 120. In particular, in various exemplary embodiments, the first and second waste ink pads 110 and 120 are formed using a single waste pad in two different orientations. In particular, the first waste ink pad 110 shown in FIG. 2 is shown in a first orientation, while the second waste ink pad 120 shown in FIG. 3 is shown in a second orientation rotated 180° about a vertical axis relative to the orientation of the first waste in pad shown in FIG. 2.

As shown in FIGS. 2 and 3, the first waste ink pad 110 has a central hole 114 formed roughly in the geometric center of the first waste ink pad 110. The first waste ink pad 110 also includes a second hole 112 that is position roughly halfway between one of the corners of the first waste ink pad 110 and the central hole 114.

Similarly, the second waste ink pad 120 includes a roughly centrally located central hole 122 and a second hole 124 that is located approximately halfway between the central hole 122 and one of the comers of the second waste ink pad 120. In particular, as shown in FIGS. 2 and 3, and more easily in seen in FIG. 4, the holes 112 and 124 are generally position at diagonally opposite comers of the first and second ink pads 110 and 120. Of course, it should be appreciated that, in actuality, the ink pads 110 and 120 are the same single waste ink pad in different orientations.

As shown in FIG. 4, the waste ink pad 100 is formed by placing the first waste ink pad 110 over and aligned with the second waste ink pad 120. In this orientation, the central holes 114 and 122 generally align, while the second holes 112 and 124 are located in diagonally opposite comers of the waste ink pad 100. In addition, when the first and second waste ink pads 110 and 120 are combined and aligned to form the waste ink pad 100, as shown in FIG. 4, a central axis or interface 140 is formed by the interface between a top surface 126 of the second waste ink pad 120 and a bottom surface 116 of the first waste ink pad 110.

Additionally, as shown in FIG. 4, a sleeve 130 is inserted into the second hole 112 of the first waste ink pad 110. In particular, in various exemplary embodiments, the sleeve 130 is inserted through the second hole 112 and butts against the top surface 126 of the second waste ink pad. The sleeve 130, the second hole 112 of the first waste ink pad and the top surface 126 of the second waste pad 120 define a chamber.

Figure 5:
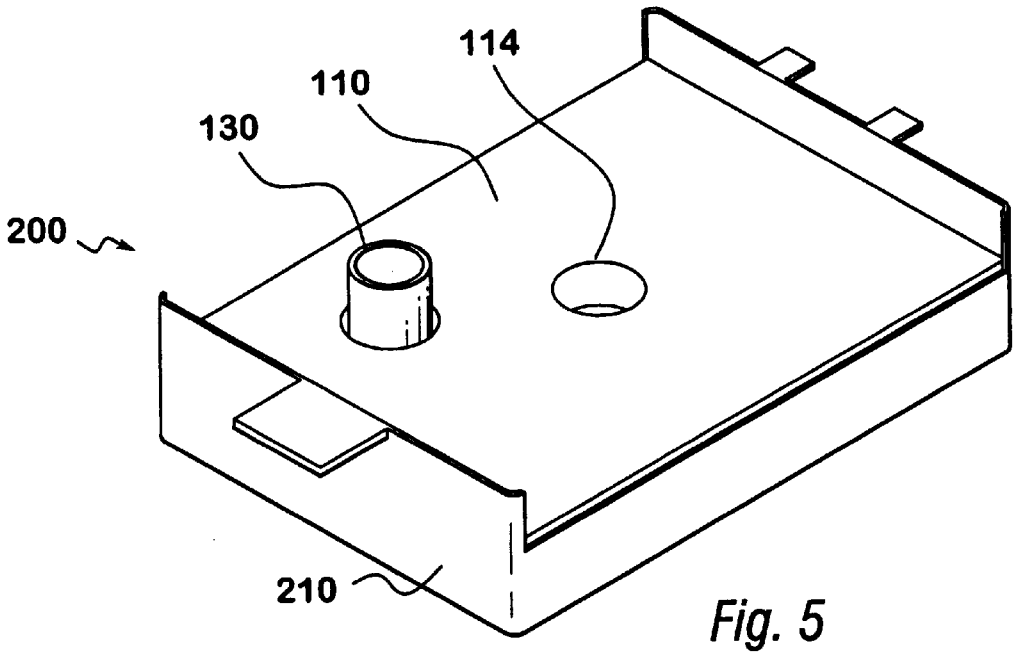
FIG. 5 is a perspective view of a waste pad system according to this invention.

FIG. 5 is a perspective view of the waste ink pad system 200 incorporating the waste ink pad 100 according to this inventions. As shown in FIG. 5, the waste ink pad system 200 includes a tray 210 in which the waste ink pad 100 is installed. A top cover (not shown) of the waste ink pad system 200 fits over the tray 210 such that the sleeve 130 extends through the cover. The sleeve 130 can be connected to a tube 75, connecting the waste ink pad system 200 to the vacuum pump, as shown in FIG. 1. U.S. patent application Ser. No. 09/594,683 filed herewith and incorporated herein by reference in its entirety, describes the waste ink accumulator 100 in greater detail. Alternatively, the waste ink pad system 200 can be used in place of the waste ink accumulator 100.

Because the sleeve 130 extends only through the first pad 110, the sleeve 130 ensures the waste ink flowing into the waste ink pad system 200 is adequately humidified. As the waste ink flowing into the waste ink pad system 200 collects within the sleeve 130, this waste ink begins to migrate through the first and second waste ink pads 110 and 120. In particular, the waste ink migrates between the first and second waste ink pads 110 and 120 along the central axis or interface 140. By concentrating the waste ink along the central axis or interface 140 between the top surface 126 of the second waste ink pad 120 and the bottom surface 116 of the first waste ink pad 110, the volatile liquid portions of the waste ink are not able to rapidly evaporate from the waste ink.

Because the waste ink remains in a volatile liquid phase for a longer period time, the waste ink is able to flow through the first and second waste ink pads 110 and 120 along the central axis interface 140 for a longer period of time. This allows the waste ink to migrate much more deeply into the first and second waste ink pads 110 and 120 from the second hole 112 formed in the first waste ink pad 110. Thus, by slowing the evaporation of the volatile liquids from the waste ink, the capacity of the first and second waste ink pads 110 and 120 to contain the waste ink increases.

Furthermore, by keeping the deposition region of the waste ink pad 100 around the sleeve 130 well humidified and/or, by keeping of the interior of the sleeve 130 well humidified, premature drying and caking of the waste ink is reduced, and optimally, is kept to a minimum.

In the past, failure to keep the deposition region at which the waste ink is introduced into conventional waste ink pads adequately humidified has caused the waste ink to dry and crust immediately upon being deposited into the conventional waste ink pads. By crusting over the point of deposition, the waste ink prevents additional waste ink from entering into or migrating throughout the waste ink pads. As a result, only a small portion of the capacity of the conventional waste ink pads usable to hold waste ink is actually used. Thus, in the conventional waste ink pads, the entire volume of the conventional waste ink pads is ineffectively and inefficiently used. In contrast, in the waste ink pad system 200 according to this invention, because the waste ink remains in a liquid form for a substantially longer time, a substantially larger portion of the waste ink capacity of the waste ink pad 100 becomes usable.

As indicated above, the first and second waste ink pads 110 and 120 shown in FIGS. 2 and 3 effectively form a single ink pad 100. Additionally, the first and second waste ink pads 110 and 120 can be manufactured as a single item, by cutting the centrally located hole 114/122 and the hole 112/124 located between the centrally located hole 114/122 and one corner of the waste ink pad. These holes can be cut in a single manufacturing process. This provides a more efficient and effective manufacturing process. In particular, the holes are formed by punching out circular material from the single pad. Then, to form the waste ink pad system 200, a first one of the single pads is installed in the ink tray 210 as the second ink pad 120 in the second orientation. Then, a second one of the single pads is installed into the tray 210 as the first waste ink pad 110 rotated 180° from orientation of the second ink pad 120 as installed in the tray 210.

Additionally, placing the two openings 112 and 124 at diagonally opposite corners of the waste ink pad 100 further extends the efficiency and capacity of the waste ink pad system 200. This occurs because the openings at diagonally opposite corners provide straightforward manufacturing and assembly reference points.

While this invention has been described in conjunction with the exemplary embodiments outlined above, it is evident that many alternative, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A fluid absorbing pad system, comprising:

a first pad having a centrally located hole and a second hole located between the centrally located hole and a comer of the first pad;

a second pad positioned adjacent to the first pad to form an interface between the first and second pads, the second pad having a centrally located hole and a second hole located between the centrally located hole and a comer of the second pad, the second holes of the first and second pads located on relatively opposite sides of the centrally located holes, such that each second hole extends only part way through a total thickness of the first and second pads such that the respective second hole of the first pad is blocked by the second pad and the respective first hole of the second pad is blocked by the second pad;

a guide member inserted into the second hole of one of the first and second pads, the guide member and the second hole of that one of the first and second pads defining a chamber; and wherein, as fluid collects in the chamber, the fluid received by the fluid absorbing system is deposited at the interface between the first and second pads.

2. The fluid absorbing pad system of claim 1, wherein the guide member allows the fluid to be absorbed into the at least one of the first and second pads before the volatile components of the fluid evaporate.

3. The fluid absorbing pad system of claim 1, further comprising a tray into which the first and second pads are placed.

4. The fluid absorbing pad system of claim 1, wherein the first and second pads are formed using a single type of pad, the first pad formed by orienting a first one of the single type of pad in a first orientation, and the second pad formed by orienting a second one of the single type of pad in a second orientation rotated 180° from the orientation of the first one of the single type of pad.

5. The fluid absorbing pad system of claim 1, wherein the guide member and the second hole of that one of the first and second pads define a chamber in which a higher humidity level than a humidity level outside the chamber, is maintained.

6. The fluid absorbing pad of claim 5, wherein the higher humidity level is maintained to allow fluid to be absorbed into the pad system before volatile components of the liquid evaporate.

7. The fluid absorbing pad system of claim 1, wherein, as fluid collects in the chamber, the fluid migrates through the first and second waste pads.

8. The fluid absorbing pad system of claim 7, wherein the fluid migrates between the first and second waste pads and along the interface of the first and second waste pads.

9. The fluid absorbing pad system of claim 8, wherein a higher humidity level than a humidity level outside the chamber is maintained in the chamber, and the fluid migration between the first and the second waste pads and along the interface of the first and second waste pads maintain the liquid phase of the fluid for a longer interval.

10. The fluid absorbing pad system of claim 1, wherein the guide member is a tubular-sleeve member.

11. The fluid absorbing pad system of claim 10, wherein, as fluid collects in the chamber, defined in part by the tubular-sleeve member, the fluid migrates through the first and second waste pads.

12. The fluid absorbing pad system of claim 11, wherein the fluid migrates between the first and second waste pads and along the interface of the first and second waste pads.

13. The fluid absorbing pad system of claim 11, wherein a higher humidity level than a humidity level outside the chamber is maintained in the chamber, and the fluid migration between the first and the second waste pads and along the interface of the first and second waste pads maintain the liquid phase of the fluid for a longer interval.

14. The fluid absorbing pad system of claim 13, wherein the tubular-sleeve member is coupled to a vacuum pump.

15. A method for manufacturing a fluid absorbing pad system, comprising:

forming a first pad with a centrally located hole and a second hole located between the hole and a second hole located between the centrally located hole and a corner of the first pad;

forming a second pad having a centrally located hole and a second hole located between the centrally located hole and a comer of the second pad;

placing the second pad adjacent to the first pad to form an interface between the first and second pads such that the second holes of the first and second pads are located on relatively opposite sides of the centrally located holes such that each second hole extends only part way through a total thickness of the first and second pads such that the respective second hole of the first pad is blocked by the second pad and the respective second hole of the second pad is blocked by the first pad; and inserting a guide member into the second hole of one of the first and second pads such that the guide member extends into that one of the first and second pads only to the interface, the guide member and the second hole of that one of the first and second pads defining a chamber.

16. The method of claim 15, further comprising placing the first and second pads into a tray.

17. The method of claim 15, wherein forming the first pad and forming the second pad comprises:

forming a single type of pad;

orienting a first one of the single type of pad in a first orientation to form the first pad; and orienting a second one of the single type of pad in a second orientation rotated 180° from the orientation of the first one of the single type of pad to form the second pad.

18. A method of using a fluid absorbing pad system that comprises a first pad having a centrally located hole and a second hole located between the centrally located hole and a comer of the first pad, a second pad positioned adjacent to the first pad to form an interface between the first and second pads, the second pad having a centrally located hole and a second hole located between the centrally located hole and a comer of the second pad, the second holes of the first and second pads located on relatively opposite sides of the centrally located holes, such that each second hole extends only part way through a total thickness of the first and second pads such that the respective second hole of the first pad is blocked by the second pad and the respective second hole of the second pad is blocked by the first pad, and a guide member inserted into the second hole of one of the first and second pads, the guide member and the second hole of that one of the first and second pads defining a chamber, the method comprising:

collecting fluid within the chamber defined by the guide member and the second hole of that one of the first and second pads;

providing the fluid received by the fluid absorbing system to the interface between the first and second pads; and absorbing the fluid into the first and second pads from the interface.

19. The method of claim 18, further comprising:

absorbing the fluid into the at least one of the first and second pads before the volatile components of the fluid evaporate.

20. The method of claim 18, further comprising:

maintaining a higher humidity level in the chamber than a humidity level outside the chamber as the ink is absorbed into the fluid absorbing pad system.

21. The method of claim 20, further comprising:

distributing the fluid into the first and second waste pads from the chamber along the interface between the first and second waste pads.

22. The method of claim 21, where:

maintaining a higher humidity level in the chamber than a humidity level outside the chamber wherein the fluid migration between the first and second waste pads and along the interface of the first and second waste pads maintain the fluid phase of the fluid for a longer interval.

* * * * *